US006279167B1

(12) United States Patent
Johnson et al.

(10) Patent No.: US 6,279,167 B1
(45) Date of Patent: Aug. 28, 2001

(54) CAP WITH A THREE-DIMENSIONAL PLUSH ANIMAL

(76) Inventors: Ben Johnson; Laurie Johnson, both of 4224 Elliot Ave. South, Minneapolis, MN (US) 55407

( * ) Notice: Subject to any disclaimer, the term of this patent is extended or adjusted under 35 U.S.C. 154(b) by 0 days.

(21) Appl. No.: 09/363,281

(22) Filed: Jul. 28, 1999

(51) Int. Cl.[7] ..... A42B 1/24

(52) U.S. Cl. ..... 2/209.13; 2/209.11; 446/27; 446/72

(58) Field of Search ..... 2/171, 172, 209.13, 2/207, 174, DIG. 11, 171.1, 175.1, 175.3, 195.1, 195.7, 195.8, 209.11, 209.12, 244, 422, 909, 918; D2/865, 866, 867, 891, 868–874; 446/27, 72

(56) References Cited

U.S. PATENT DOCUMENTS 1,485,638 * 3/1924 Smith ..... 448/27
1,690,778 * 11/1928 Ford ..... 446/27
2,611,902 * 9/1952 Rockmore ..... 2/171.1
2,735,109 * 2/1956 Feldman ..... 2/171.1
3,813,016 * 5/1974 Bohannan ..... 224/5
4,860,387 * 8/1989 Williams ..... 2/244
5,070,546 * 12/1991 Stazo et al. ..... 2/199
5,542,122 * 8/1996 Moldovan ..... 2/69
5,561,864 * 10/1996 DeMars ..... 2/209.13
5,734,991 * 4/1998 Schmid ..... 2/69
6,049,904 * 4/2000 Siracusa ..... 2/4

* cited by examiner

*Primary Examiner*—John J. Calvert
*Assistant Examiner*—Katherine Moran
(74) *Attorney, Agent, or Firm*—Norman P. Friederichs

(57) ABSTRACT

An article of apparel for a human head in the nature of a cap having a button permanently attached thereto with a three-dimensional plush animal adapted to be removably attached to the cap. The three-dimensional plush animal having a strip of cloth attached to the belly portion of the three-dimensional plush animal. The strip of cloth has an opening adapted to snugly receive the button. The button is removably inserted through the opening thereby removably attaching the three-dimensional plush animal to the cap.

26 Claims, 3 Drawing Sheets

CAP WITH A THREE-DIMENSIONAL PLUSH ANIMAL

FIELD OF THE INVENTION

The present invention relates to apparel for human heads, and more particularly to caps having removably attached plush animals with buttons located near their bellies.

BACKGROUND OF THE INVENTION

Many parents place caps or hats on their young children's heads to keep the children warm when outside. People have been decorating their clothing and their children's clothing for many, many years. People have placed buttons, bows and other ornamental features on clothing for a long time.

Toys, such as animals and cartoon characters, are well known. At times, people have decorated their clothing by imprinting cartoon characters or animals on their clothing.

U.S. Pat. No. 5,542,122 describes an apparel article in the nature of clothing or a backpack which includes a first fabric material onto which is sewn, at least in part, a stuffed animal as an ornamental feature. The stuffed animal may be removable or permanently attached to the apparel article. The location of the animal may be on the shoulder of a garment or the top arm portion such that the animal appears to perch or hug onto the body of the wearer of the apparel article. The stuffed animal may be removably attached by using either snaps (press buttons) or VELCRO™ (hook and loop mechanism). One portion of the snap or VELCRO™ is permanently attached to the stuffed animal and the remaining portion of the snap or VELCRO™ is permanently attached to the apparel article. The stuffed animal can only be attached at the exact location of the snaps or hook and loop mechanism. The stuffed animal cannot be placed in other locations.

SUMMARY OF THE INVENTION

The present invention relates to a cap for a human head with a three-dimensional plush animal removably attached thereto. The present invention comprises a cap generally sized to fit the heads of infants or young children though the cap may be made in any size to fit different sized heads. The cap of the present invention may be constructed of a material which is polyester or natural fibers typically used for clothing. The cap has an outer surface and an inner surface.

The cap has a button which is attached to the outer surface. The term button may be defined as a small knob or disk secured to an article (as of clothing) and used as a fastener by passing it through a slit, loop or opening in cloth.

The three-dimensional plush animal of the present invention may be constructed of a material which is polyester or natural fibers typically used for three-dimensional plush animals. Both the cap and the three-dimensional plush animal may be constructed of a material which may be washed in a typical household cloths washing machine.

The three-dimensional plush animal has a belly portion. Typically the belly portion would be the under side of the animal. The three-dimensional plush animal may have a strip of cloth attached, either permanently or removably, to the belly portion of the three-dimensional plush animal.

The strip of cloth may have a middle portion which defines an opening adapted to snugly receive the button. The button is removably inserted through the opening thereby attaching the three-dimensional plush animal to the cap. The button serves to releasibly secure the three-dimensional plush animal to the cap or other garment or apparel. Buttons attached to other apparel, such as shirts or pants, alternatively may be inserted into the opening if a person desires to wear the three-dimensional plush animal in different locations on his/her body.

IN THE DRAWINGS

DETAILED DESCRIPTION OF THE PRESENT INVENTION

Figure 1:
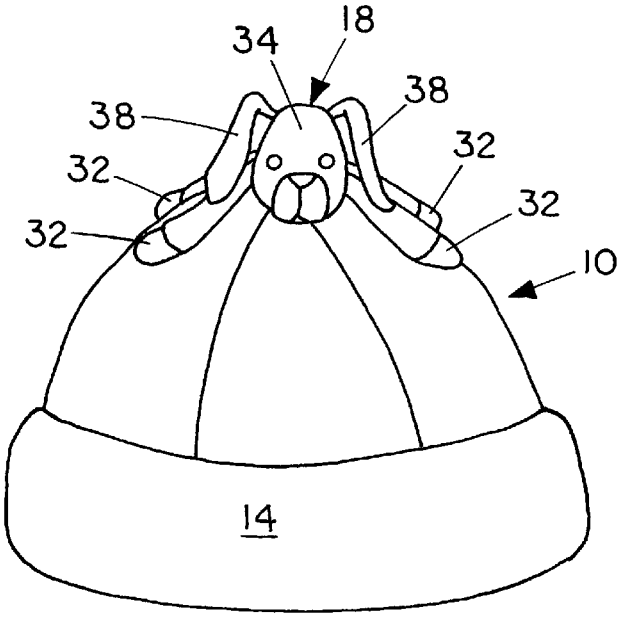
FIG. 1 shows a side view of a cap with a three-dimensional plush animal attached thereto.
Figure 4:
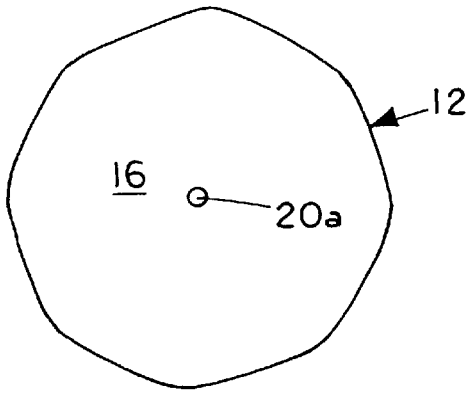
FIG. 4 shows a bottom view of the cap.
Figure 5:
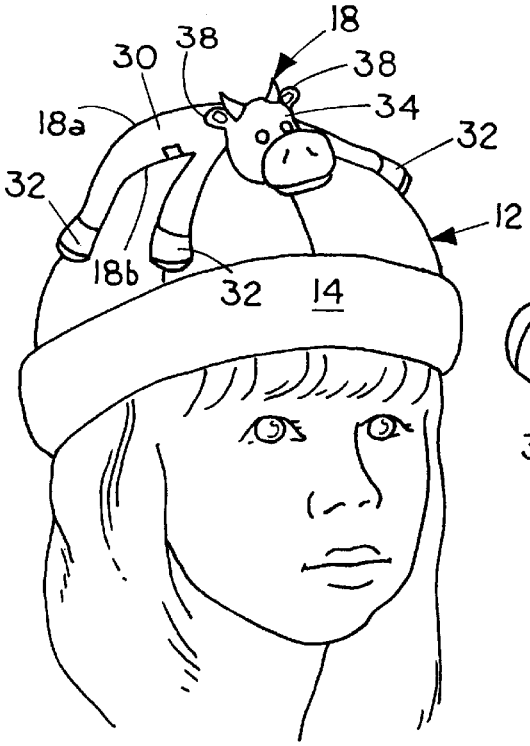
FIG. 5 shows a side view of a person wearing the cap with the three-dimensional plush animal attached thereto.

A cap 12 with a three-dimensional plush animal 18 of the present invention 10 is illustrated in FIGS. 1 and 5. A cap 12 for a human head has an outer surface 14. The cap 12 has an inner surface 16 which is shown in FIG. 4. The cap 12 may be constructed of a material such as polyester, cotton, or wool. The cap 12, for example, may be constructed of any material from which clothes are typically made. The cap 12 may be constructed from a material which assists in keeping heat from escaping from the wearer's head. The cap 12 may be constructed from a material which simply protects the wearer's head from the sun. Preferably the material is machine washable.

The cap 12 may vary in size. The cap 12 may be sized to fit the human head of an infant or young child. The cap 12 may be sized to fit an adult human head.

The cap 12 may be made of various colors. The cap 12 may be made in one color or may be made in a plurality of colors. The cap 12 may be made in a similar color to the coloring of the three-dimensional plush animal 18. Preferably, the cap 12 will be made in colors which are captivating to infants and young children.

Figure 2:
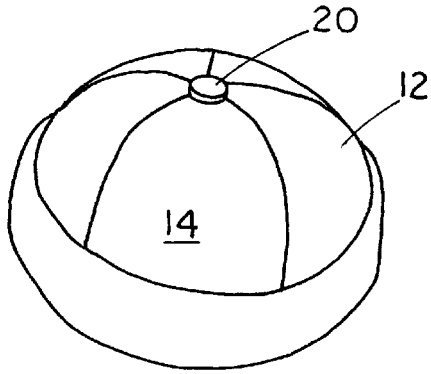
FIG. 2 shows a top view of the cap showing a button.
Figure 3:
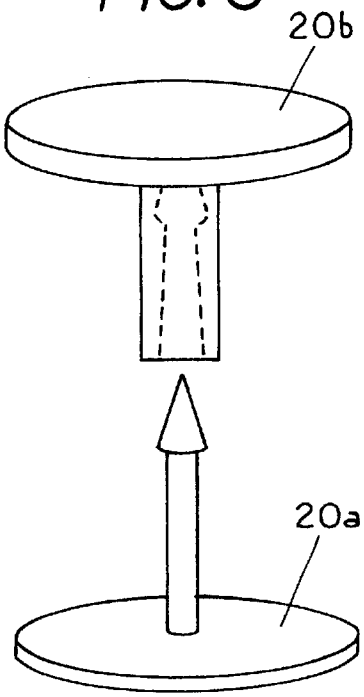
FIG. 3 shows a mechanism to secure a button to the cap.

The outer surface 14 has a button 20 permanently attached thereto as seen in FIG. 2. The button 20 may be sewn or otherwise attached to the outer surface 14. FIG. 3 shows a mechanism by which the button 20 may be attached to the cap 12. A pronged portion 20*a* may be inserted through the inner surface 16 of cap 12. The pronged portion 20*a* may then be inserted into the receiving portion 20*b* on the outer surface 14 of the cap 12, thus, forming and securing the button 20 to the cap 12. The button 20 may be attached to the cap 12 by any suitable mechanism.

The button 20 may be constructed of hard plastic or metal. Preferably the button 20 will be constructed of plastic so that it will not rust if it comes into contact with water.

The button 20 may be made in various colors. The button 20 will preferably be made in a similar color or a plurality of colors in which the cap 12 and the three-dimensional plush animal 18 are made.

The button 20 may vary in diameter. The diameter of the button 20 may be ⅛ of an inch or larger. Preferably the diameter will be similar to the diameter of buttons typically worn on clothes. Preferably the diameter will be approximately ¼ inch to ½ inch.

Figure 6:
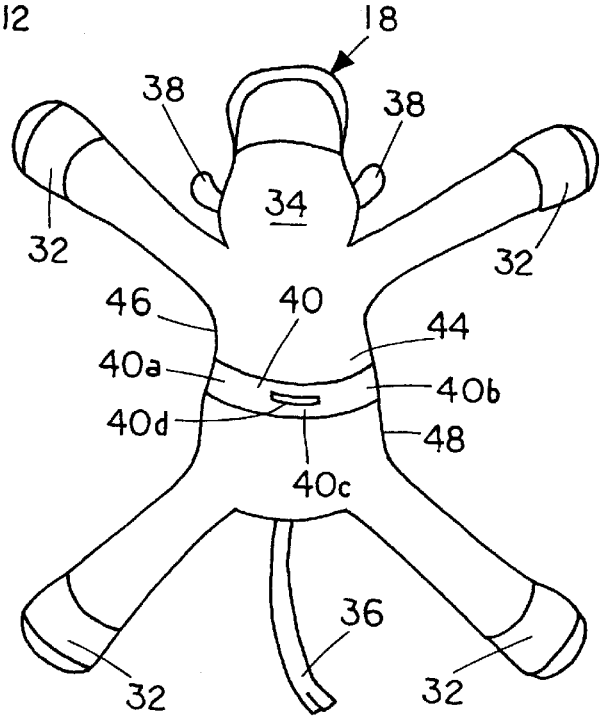
FIG. 6 shows a bottom view of the first embodiment of the three-dimensional plush animal showing the strip of cloth permanently attached thereto with an opening for a button defined therein.

As shown in FIG. 5, the three-dimensional plush animal 18 may include a body 30, a plurality of legs 32, and a head 34. Some of the three-dimensional plush animals 18 may include a tail 36 as seen in FIG. 6. The three-dimensional plush animal 18 may include a plurality of ears 38 or other body parts which specific animals typically contain.

The three-dimensional plush animal 18 may be depict any real animal or imaginary animal. The three-dimensional plush animal 18 may depict a mammal such as a rabbit, a bull, a squirrel, or a cat. The three-dimensional plush animal 18 may depict an amphibian such as a frog. The three-dimensional plush animal 18 may depict a fictional character such as a dragon, a unicom, or a cartoon character. The three-dimensional plush animal 18 may depict any other real or imaginary animal. The three-dimensional plush animal 18 may appear realistic, though generally smaller in size, or may appear as a general replication of the animal.

For example, if the three-dimensional plush animal 18 were a cat, the three-dimensional plush animal 18 may be made in the colors of grey, white, black or other natural color for cats. The three-dimensional plush animal 18 depicting a cat may have four legs and a long tail. The three-dimensional plush animal 18 depicting a cat may have two pointy ears and a face which resembles that of a cat. The three-dimensional plush animal 18 may depict any real or fictional animal.

The three-dimensional plush animal 18 will have a length, width, and height commiserate with the size of the cap 12. The three-dimensional plush animal 18 may be large enough so it is noticeable and the three-dimensional plush animal 18 may be small enough so it may be attached to the cap 12 by use of the button 20. The length may be measured from the head 34 to the tip of the tail 36. The width may be measured from the right side of the three-dimensional plush animal 18 to the left side of the three-dimensional plush animal 18. The height may be measured from the under side (belly region) of the three-dimensional plush animal 18 to the back side (spine region) of the three-dimensional plush animal 18.

The length of the three-dimensional plush animal 18, for example, may be between 2 inches and 10 inches. The width of the three-dimensional plush animal 18, for example, may be approximately ½ inch or wider. The height of the three-dimensional plush animal 18, for example, may be approximately ¼ inch or taller. Preferably the length of the three-dimensional plush animal 18 will be between 3 inches and 6 inches. Preferably the width of the three-dimensional plush animal 18 will be between 1 and 5 inches. Preferably the height of the three-dimensional plush animal 18 will be between ½ inch and 2 inches.

The three-dimensional plush animal 18 may be constructed of a material which is typically used for three-dimensional plush animals. The material may be cotton, polyester, or other material. Preferably the material is soft to the touch and machine washable. The material of the three-dimensional plush animal 18 may contain stuffing such as a cotton filling, a polyester filling, a plurality of beans, a plurality of sand particles or other material typically used to fill plush animals.

In FIG. 6, the three-dimensional plush animal 18 has a back portion 42 and a belly portion 44. The back portion 42 is not shown; however, it is equivalent to the back portion 18*a* discussed below. The belly portion 44 has a right portion 46 and a left portion 48. The back portion 42 is typically the three-dimensional plush animal's 18 back. The belly portion 44 is typically the under side of the three-dimensional plush animal 18. The right portion 46 is typically the right side of the belly portion 44 of the three-dimensional plush animal 18. The left portion 48 is typically the left side of the belly portion 44 of the three-dimensional plush animal 18.

The three-dimensional plush animal 18 may have a strip of cloth 40 attached to the belly portion 44 of the three-dimensional plush animal 18 as shown in FIG. 6. In FIG. 6, the strip of cloth 40 may have a right end 40*a*. The strip of cloth 40 may have a left end 40*b*. The right end 40*a* is sewn or otherwise attached to the right portion 46 of the belly portion 44 of the three-dimensional plush animal 18. The left end 40*b* is sewn or otherwise attached to the left portion 48 of the belly portion 44 of the three-dimensional plush animal 18. The right end 40*a* and the left end 40*b* may be permanently or removably attached to the belly portion 44 of the three-dimensional plush animal 18. Located on the strip of cloth 40, between the right end 40*a* and the left end 40*b*, is the middle portion 40*c*. The middle portion 40*c* defines an opening 40*d*. The opening 40*d* is adapted to snugly receive the button 20 as discussed above.

Figure 7:
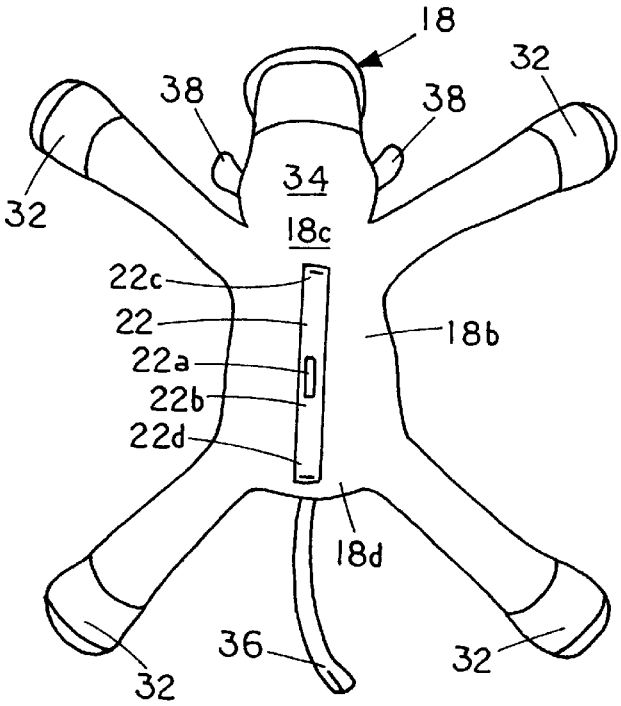
FIG. 7 shows a bottom view of the second embodiment of the three-dimensional plush animal showing the strip of cloth permanently attached thereto with an opening for a button defined therein.

In a second embodiment, shown in FIG. 7, the three-dimensional plush animal 18 has a back portion 18*a* (shown in FIG. 5) and a belly portion 18*b*. The belly portion 18*b* has a forward portion 18*c* and a rearward portion 18*d*. The back portion 18*a* is typically the three-dimensional plush animal's 18 back. The belly portion 18*b* is typically the under side of the three-dimensional plush animal 18. The forward portion 18*c* is typically the belly portion 18*b* closest to the three-dimensional plush animal's 18 head 34. The rearward portion 18*d* is typically the belly portion 18*b* closest to the tail 36 of the three-dimensional plush animal 18.

The three-dimensional plush animal 18 may have a strip of cloth 22 attached to the belly portion 18*b* of the three-dimensional plush animal 18 as shown in FIG. 7. The strip of cloth 22 has a forward end 22*c* and a rearward end 22*d*. The forward end 22*c* is sewn or otherwise attached to the forward portion 18*c* of the belly portion 18*b* of the three-dimensional plush animal 18. The rearward end 22*d* is sewn or otherwise attached to the rearward portion 18*d* of the belly portion 18*b* of the three-dimensional plush animal 18. Located on the strip of cloth 22, between the forward end 22*c* and the rearward end 22*d*, is the middle portion 22*b*. The middle portion 22*b* defines an opening 22*a*. The opening 22*a* is adapted to snugly receive the button 20.

Figure 8:
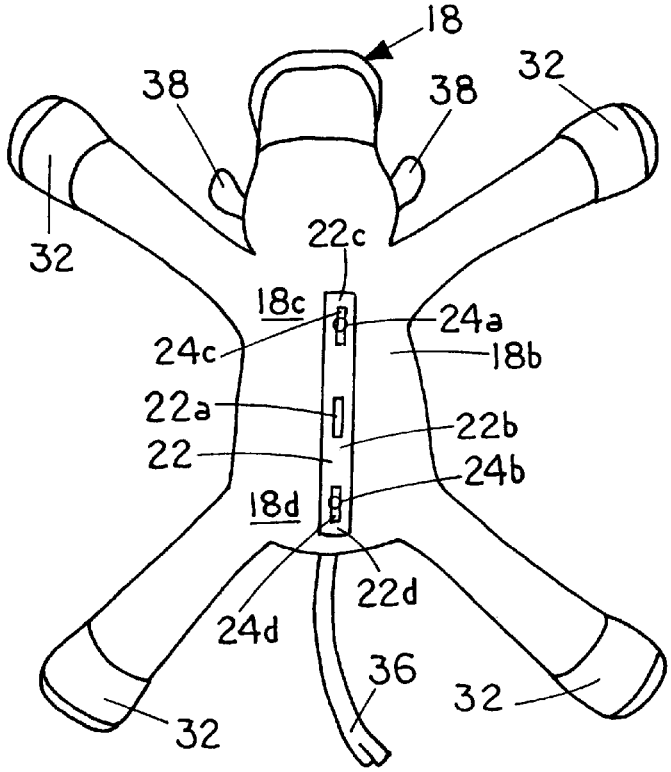
FIG. 8 shows a bottom view of the three-dimensional plush animal showing the strip of cloth removably attached thereto.

In FIG. 8, the three-dimensional plush animal 18 is shown with the strip of cloth 22 being removably attached to the belly portion 18*b*. FIG. 8 shows the second embodiment of the strip of cloth 22 being removably attached to the three-dimensional plush animal 18. The first embodiment shown in FIG. 6 may also be removably attached in a manner similar to the second embodiment. The strip of cloth 22 has a forward end 22*c* and a rearward end 22*d*. The rearward end 22*d* and the forward end 22*c* are removably attached to the rearward portion 18*d* and the forward portion 18*c* respectively. The mechanism used for removably attaching the strip of cloth 22 to the belly portion 18*b* may be any appropriate mechanism. The strip of cloth 22 may be removably attached to the belly portion 18*b* by using VELCRO™ which is a hook and loop mechanism. The strip of cloth 22 may be removably attached to the belly portion 18*b* by using a plurality of push buttons or snaps. The forward end 22*c* may define a second opening 24*c*. The rearward end 22*d* may define a third opening 24*d*. The second opening 24*c* may be adapted to snugly receive a second button 24*a*. The third opening 24*d* may be adapted to snugly receive a third button 24*b* as shown in FIG. 8.

Figure 9:
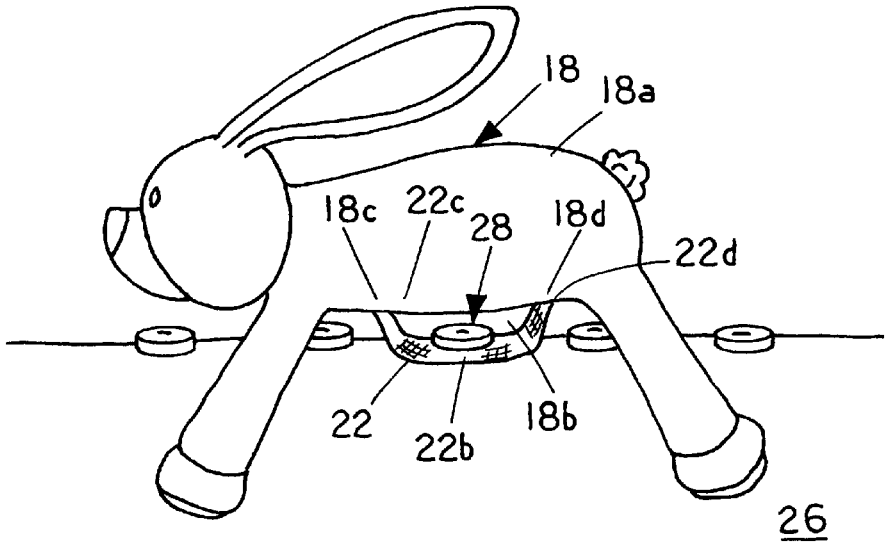
FIG. 9 shows a side view of the three-dimensional plush animal removably attached to a shirt.

FIG. 9 shows the three-dimensional plush animal 18 removably attached to a shirt 26. A shirt button 28 sewn onto the shirt 26 may be inserted into the opening 22*a* of the strip of cloth 22 which is attached to the three-dimensional plush animal 18. The three-dimensional plush animal 18 may be removably attached to any article which contains buttons that fit through the opening 22*a* of the strip of cloth 22. The shirt 26 is simply one example of the different locations to which the three-dimensional plush animal 18 may be removably attached.

While preferred embodiments of the present invention have been disclosed, one skilled in this art will recognize that modifications may be made without departing from the broader scope of the present invention.

We claim:

1. An article of apparel for a human head comprising:

a cap having an outer surface and an inner surface;

the outer surface having a button attached thereto;

the button having a diameter;

a three-dimensional plush animal adapted to be removably attached to the cap;

the three-dimensional plush animal having a back portion and a belly portion;

the belly portion having a right portion and a left portion;

a strip of cloth having a right end, a left end, and a middle portion;

the right end being attached to the right portion;

the left end being attached to the left portion;

the middle portion defining an opening adapted to snugly receive the button;

the button being removably inserted through the opening thereby removably attaching the three-dimensional plush animal to the cap.

2. The article of apparel for a human head of claim 1, wherein the right end is permanently attached to the right portion and the left end is permanently attached to the left portion.

3. The article of apparel for a human head of claim 1, wherein the right end is removably attached to the right portion and the left end is removably attached to the left portion.

4. The article of apparel for a human head of claim 1, wherein the three-dimensional plush animal is filled with a cotton filling.

5. The article of apparel for a human head of claim 4, wherein the three-dimensional plush animal has a plurality of legs.

6. The article of apparel for a human head of claim 5, wherein the three-dimensional plush animal has a head.

7. The article of apparel for a human head of claim 6, wherein the three-dimensional plush animal has a body.

8. The article of apparel for a human head of claim 7, wherein the three-dimensional plush animal has a plurality of ears.

9. The article of apparel for a human head of claim 8, wherein the three-dimensional plush animal has a tail.

10. The article of apparel for a human head of claim 9, wherein the three-dimensional plush animal is a mammal.

11. The article of apparel for a human head of claim 10, wherein the three-dimensional plush animal is a dog.

12. The article of apparel for a human head of claim 8, wherein the three-dimensional plush animal is an cow.

13. The article of apparel for a human head of claim 12, wherein the three-dimensional plush animal is a rabbit.

14. The article of apparel for a human head of claim 4, wherein the three-dimensional plush animal is an imaginary animal.

15. The article of apparel for a human head of claim 4, wherein the three-dimensional plush animal having a length between 3 inches and 6 inches, the three-dimensional plush animal having a width between 1 inch and 5 inches, the three-dimensional plush animal having a height between ½ inch and 2 inches.

16. The article of apparel for a human head of claim 15, wherein the length of the three-dimensional plush animal is 5 inches, the width of the three-dimensional plush animal is 3 inches, the height of the three-dimensional plush animal is 1 inch.

17. An article of apparel for a human head comprising:

a cap having an outer surface and an inner surface;

the outer surface having a button attached thereto;

the button having a diameter;

a three-dimensional plush animal adapted to be removably attached to the cap;

the three-dimensional plush animal having a back portion and a belly portion;

the belly portion having an forward portion and a rearward portion;

a strip of cloth having a forward end, a rearward end, and a middle portion;

the forward end being attached to the forward portion;

the rearward end being attached to the rearward portion;

the middle portion defining an opening adapted to snugly receive the button;

the button being removably inserted through the opening thereby removably attaching the three-dimensional plush animal to the cap.

18. An article of apparel for a human head comprising:

a cap having an outer surface and an inner surface;

the outer surface having a button attached thereto;

the button having a diameter;

a three-dimensional plush animal adapted to be removably attached to the cap;

the three-dimensional plush animal having a back portion and a belly portion;

the belly portion having a forward portion and a rearward portion;

a strip of cloth having a forward end, a rearward end, and a middle portion;

the forward end being removably attached to the forward portion;

the rearward end being removably attached to the rearward portion;

the middle portion defining an opening adapted to snugly receive the button;

the button being removably inserted through the opening thereby removably attaching the three-dimensional plush animal to the cap.

19. The article of apparel for a human head of claim 18, further comprising a second button attached to the forward portion of the belly portion of the three-dimensional plush animal, a third button attached to the rearward portion of the belly portion of the three-dimensional plush animal, the forward end defining a second opening adapted to snugly receive the second button, the rearward end defining a third opening adapted to snugly receive the third button, the second button being removably inserted through the second opening thereby removably attaching the forward end to the forward portion of the three-dimensional plush animal, the third button being removably inserted through the third opening thereby removably attaching the rearward end to the rearward portion of the three-dimensional plush animal.

20. An article of apparel for a human head comprising:

a cap having an outer surface and an inner surface; said outer surface having a button attached thereto; said button having a diameter;

a three-dimensional plush animal adapted to be removably attached to said cap; said three-dimensional plush animal having a back portion and a belly portion; said plush animal further including a strip having a first end, a second end, and a middle portion; said first end being attached to said belly portion at a first location; said second end of said strip being attached to said belly portion at a location spaced from said first attached location; said middle portion of said strip having defined therein an opening adapted to snugly receive said button; said button being removably inserted through said defined opening in said strip thereby removably attaching said three-dimensional plush animal to said cap.

21. The article of clothing of claim 20 wherein said strip includes a pair of side edges and wherein said side edges are unattached to said planar portion of said plush animal.

22. The article of clothing of claim 20 wherein said first and second end attachments comprise the sole attachment of said strip to said belly portion.

23. An article of apparel for a human head comprising:

a cap having an outer surface and an inner surface; said outer surface having a button attached thereto; said button having a diameter;

a three-dimensional plush animal adapted to be removably attached to said cap; said three-dimensional plush animal having a back portion and a belly portion; said plush animal further including a strip having a first end, a second end, and a middle portion; said first end being attached to said plush animal at a first location; said second end of said strip being attached to said plush animal at a second location spaced from said first attached location; said middle portion of said strip having defined therein an opening adapted to snugly receive said button; said button being removably inserted through said defined opening in said strip thereby removably attaching said three-dimensional plush animal to said cap.

24. The article of apparel of claim 23 wherein said strip includes a pair of side edges and wherein said side edges are unattached to said planar portion of said plush animal.

25. The article of apparel of claim 23 wherein said first and second end attachments comprise the sole attachment of said strip to said belly portion.

26. The article of apparel of claim 25 wherein said cap includes a plurality of buttons and wherein said strip defines a plurality of openings adapted to receive corresponding of said buttons.

* * * * *